United States Patent [19]

Ballarini

[11] Patent Number: 4,481,740

[45] Date of Patent: Nov. 13, 1984

[54] TOOL PROFILE GRINDING MACHINE, WITH MECHANICAL ADJUSTMENT OF THE GRINDING WHEEL AND POSITIONING OF THE TOOL INTERRELATED

[76] Inventor: Gaspare Ballarini, Via Sigismondo, 33, Cattolica (Forlì), Italy

[21] Appl. No.: 319,053

[22] Filed: Nov. 6, 1981

[30] Foreign Application Priority Data

Nov. 14, 1980 [IT] Italy ..... 44027 A/80

[51] Int. Cl.[3] ..... B24B 17/02

[52] U.S. Cl. ..... 51/100 R; 51/224; 409/111; 409/123

[58] Field of Search ..... 51/33 R, 92 R, 93, 100 R, 51/100 P, 218 R, 224; 409/111, 112, 123

[56] References Cited

U.S. PATENT DOCUMENTS

| | | | |
|---|---|---|---|
| 2,038,455 | 4/1936 | Studer | 51/100 P |
| 2,225,915 | 12/1940 | Losier | 51/100 R |
| 2,412,653 | 12/1946 | Ross | 51/100 R |
| 2,434,834 | 1/1948 | Civitarese | 51/92 R |
| 2,477,135 | 7/1949 | Marker et al. | 51/100 R |
| 2,682,731 | 7/1954 | Studer | 51/100 P |
| 4,026,073 | 5/1977 | Betzler | 51/100 R |
| 4,296,571 | 10/1981 | Horvath | 51/33 R X |

*Primary Examiner*—Robert P. Olszewski

[57] ABSTRACT

A shaping machine for making profiles on tools includes a mechanism for the mechanical adjustment of a grinding wheel at the same time as a positioning of the tool, to obtain substantially identical and accurate tool pieces using a dummy template. Movement of the grinding wheel and tool workpiece allows for the making of profiles of different shapes and sizes, having both concave and convex parts. The machine can also be used for grinding already moulded profiles to sharpen tools for example.

10 Claims, 6 Drawing Figures

TAV. 2

TAV. 3

TOOL PROFILE GRINDING MACHINE, WITH MECHANICAL ADJUSTMENT OF THE GRINDING WHEEL AND POSITIONING OF THE TOOL INTERRELATED

FIELD AND BACKGROUND OF THE INVENTION

The present invention relates, in general to shaping machines, and in particular, to a new and useful profiled tool shaping machine.

For different types of cutting and shaping operations, particularly for the manufacture of wooden moulded frames, tools consisting of blades ending in a sharp profile of a shape corresponding to the profile of the frame or piece to be obtained, are used. These blades are mounted on high speed rotating millers to cut and shape the wood.

Such blades or tools are made using a grinding wheel. When working the shaped profile of a tool, the grinding wheel should be variously oriented, so that it can make a corresponding properly oriented inclined chamfer, at the edge of the tool. If this is not done, when the tool is used to shape wood, the wood will be burnt in correspondence with the profile portion of the tool that was not properly grinded. The forming of shaped tools is also effected by means of machines having three working heads, each of which is differently inclined to effect the forming of a part of the tool profile. The inclination of each head is pre-set, and then kept unchanged during the whole working operation.

Other machines are provided, instead, with only one head which is manually oriented to the left or right by an operator. The tool pieces obtained by such machines are not all exactly the same, since their manufacture depends on the operator's skill. The working speed, in fact, is greatly hindered by possible excessive deviations from the required shape.

SUMMARY OF THE INVENTION

Such inconveniences as noted above, can be avoided if the machine according to the present invention is used. To this end, the machine of the invention is provided with one head only, and is mechanically set in the proper position as it follows the moulding or template to be copied. Both concavely and convexly bending profiles of any shape can be obtained and identical pieces are made at a very high working speed.

Furthermore, the same machine may also be used as a grinder, if the grinding disc or wheel is rotated through 90°.

Accordingly an object of the present invention is to provide a profiled tool shaping machine which comprises a machine frame, a single work head with a single grinding disc or wheel which is rotatably mounted to the frame about a vertical axis, a sliding work table which can slide in orthogonal directions in a horizontal plane mounted on the machine frame, a work piece holder for holding a work piece from which a tool is to be cut, connected to the work table, a dummy template connected to the work table, a pantographic feeler positioning table with a feeler for engaging the template, connected to the frame for holding the feeler fixed so that the work table can move in orthogonal directions as the template moves past the feeler, and an actuator lever with linkage connected to the pivotable working head and having a linkage connecting the lever to the sliding work table to cause pivoting of the grinding disc by a selected amount with translation of the work table.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

The drawings represent the machine of the invention, by way of example, since various embodiments thereof can have different sizes and different construction features.

Figure 5:
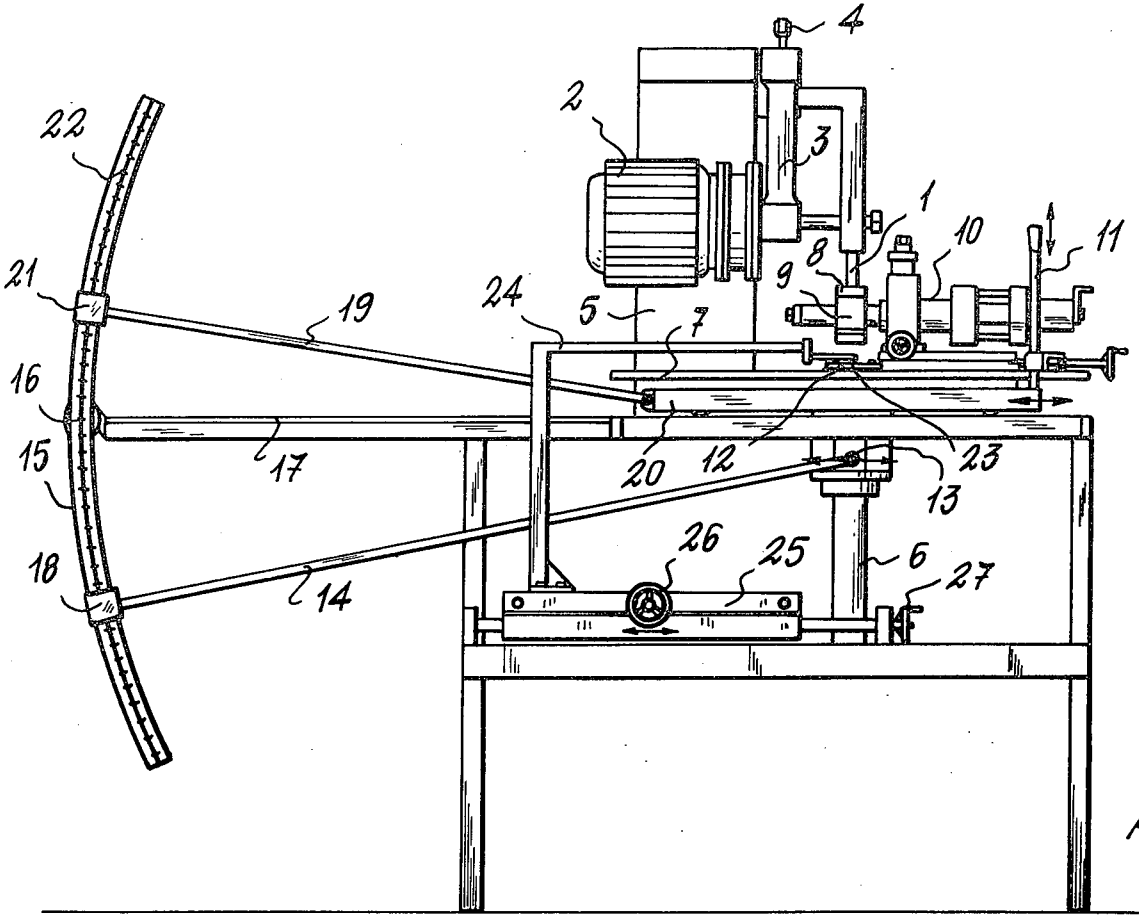
FIG. 5 is a front elevational view of the machine of the invention being used as a shaping machine.
Figure 6:
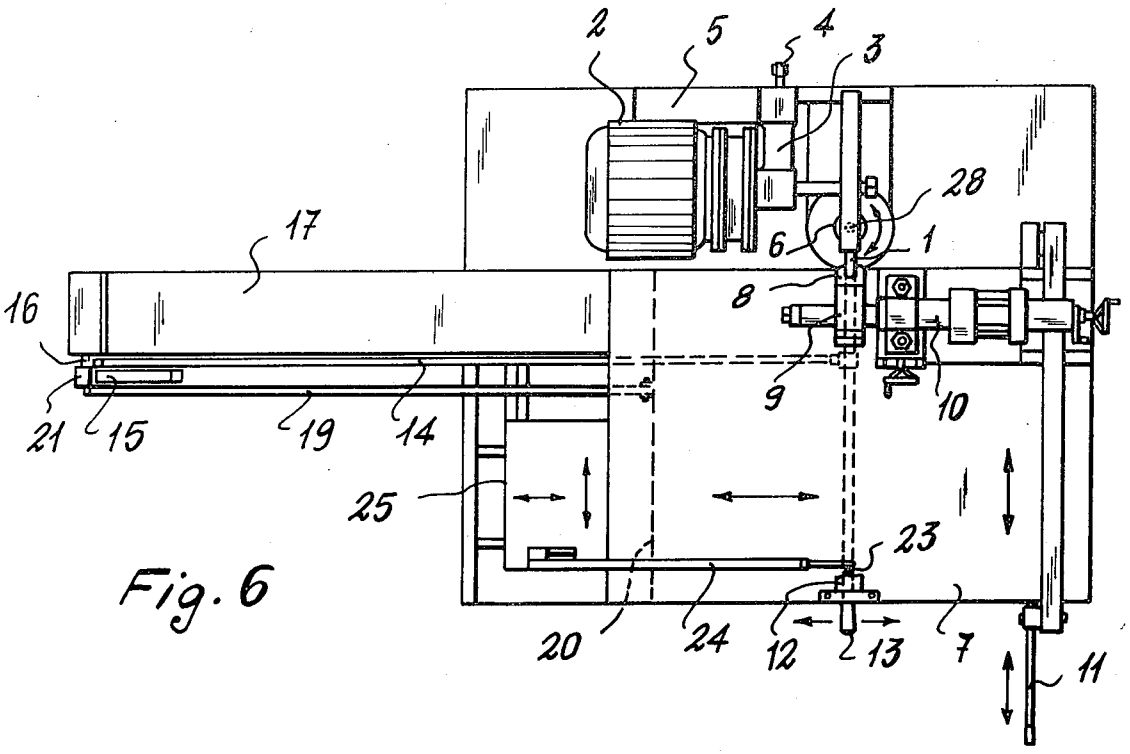
FIG. 6 is a top plan view of the machine in FIG. 5.

Referring to FIGS. 5 and 6, a grinding disc or wheel is connected to the shaft of an adjustable speed motor 2 which, in turn is supported by an arm 3 that is adjustable by means of a screw 4, which serves to compensate for the progressive wear of the grinding disc and for determining the chamfer width as will be explained later. Arm 3 is supported by rod 5, secured to vertical shaft 6 which may rotate about its own vertical axis. The whole head with the grinding disc 1 can thus rotate about this vertical axis.

A work table or plane 7 supports a tool holder which carries a tool 8 to be profiled. The tool or work piece from which the tool is to be made, can be mounted separately on table 7 or onto miller 9. An adjustable supporting device 10 of the miller or tool holder 9, is provided with a dividing head or mechanism that permits the setting, in a proper position, of different miller blades one after the other in quick succession, after a previous initial setting.

Plane or table 7 can be shifted backwards and forwards (in the direction of the vertical double arrows in FIG. 6) by means of lever 11. Table 7 fixedly carries a master dummy template 12, which has the same profile that is intended to be reproduced on the tool. A lever 13 for rotating shaft 6 and therefore the whole working head is also provided. This lever 13 is also connected, by means of a bar 14, to an arcuate compensator 15, capable of rotating around a horizontal pivot 16 applied to the end of a side extension 17 of the machine frame. The point at which bar 14 couples with compensator 15, as well as that point at which the other end of the bar couples with lever 13, can be adjusted by means of a slide 18, slidably mounted on compensator 15.

Another bar 19 couples carriage or sliding work table 20 with compensator 15, in a position which can be adjusted by means of a slide 21 which is also slidable on compensator 15. Carriage 20 may slide in a transverse direction, as indicated by the upper horizontal arrow in FIG. 5, pulling plane 7 also along for horizontal motion. Due to the coupling between bar 14, compensator 15, bar 19 and carriage 20, the carriage is set in motion each time lever 13 is moved, which makes both the inclination of the grinding disc of the working head and the translation of the tool to be profiled, move together. More specifically, when slide 21 is at the center of compensator 15 (at pivot 16), motion of the lever 13 does not move carriage or table 20, and the tool 8 is not shifted. There is however a variation in the inclination of the grinding disc or wheel. This permits the grinding and chamfering even of very small pieces. The more slide 21 is lifted on compensator 15, the more will carriage 20 as well as the corresponding tool, translate, which allows bigger pieces to be profiled.

Figure 1:
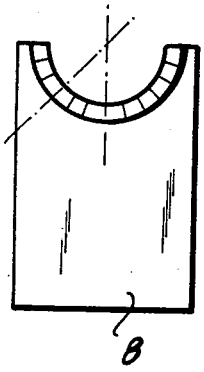
FIG. 1 is top plan view of a profiled tool which can be cut with the shaping machine of the invention, and which has a concave portion.
Figure 2:
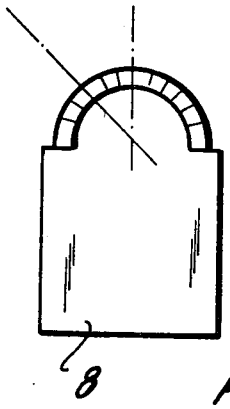
FIG. 2 is a view similar to FIG. 1 of another tool which can be cut with the machine of the invention having a convex portion.
Figure 3:
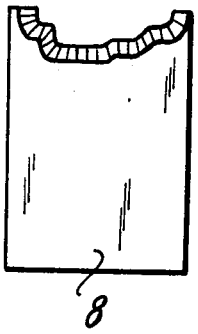
FIG. 3 is a view similar to FIG. 1 of a tool which can be cut using the machine of the invention with both convex and concave portions.

If slide 21 is positioned under pivot 16, the shifting of the working head with respect to the translation of the carriage is contrary to that of the previous case. This permits the making of convexly bending profiles, as indicated in FIG. 2.

A graduated scale 22, which is duly calibrated, is provided on compensator 15 in order to choose, each time, the most suitable coupling.

A feeler 23 for the template 12, is supported by an arm 24 secured to a horizontal pantographic feeler positioning table 25. By means of handwheels 26 and 27, it is possible to adjust the position of table 25 (and that of the feeler 23 accordingly) in the two orthogonal directions indicated in FIGS 5 and 6. The position of the grinding disc too should be pre-adjusted, in order to set it (or at least the plane in which disc 1 is contained) exactly on the vertical axis of rotation of shaft 6. To this end there is provided a pin 28 (see FIG. 6) which can be temporarily lifted to touch the lower part of grinding disc 1. Once the adjustment has taken place, pin 28 is moved back to its seat again.

After pre-setting the position of the various elements, the operator will act upon levers 11 and 13 so as to make feeler 23 follow the profile of template 12. As a consequence of this the variation in the position of the tool and that in the inclination of the grinding disc will take place exactly at the same time, since such mutual positions depend on mechanical couplings and not on the operator's personal skill. In order to make the machine even easier to handle, it is possible to replace the two control levers 11 and 13 by only one lever capable of controlling a motion along two orthogonal directions.

Figure 4:
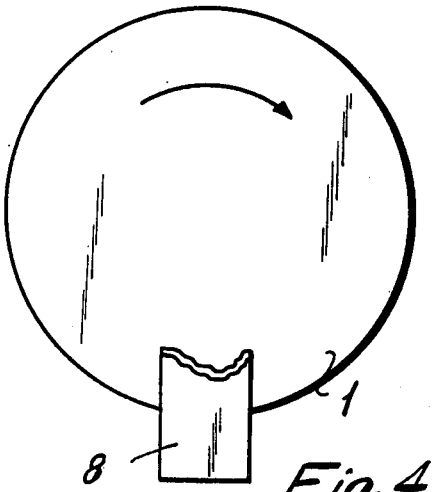
FIG. 4 is a view of a grinding wheel positioned to grind tools according to the invention.

By uncoupling bar 14, the grinding wheel can be rotated through 90° and set in the position of FIG. 4, to grind a surface of an already profiled tool (e.g. for sharpening it). In this case, the tool too will be set in a different position, and the screw drive carriage will be actioned and fed. As to the rotation of the head, reference points set at 90°, 45° and at any other suitable angle will be provided. The machine can be equipped with any necessary accessories for the most proper functioning thereof.

As shown in FIG. 6, the vertical axis of shaft 6 is offset from the axis of grinding disc 1, in a direction away from the tool 8 so that a selected chamfer can be cut on the edge of the tool. Also, while the pantographic table 25 can be set, it is held fixed while the tool is being cut. In this way the fixed feeler 23 causes movement of the plane or table 7 (through the sliding table 20) in a direction of the vertical arrows shown in FIG. 6, as the template 12 moves past the feeler 23, using levers 11 and 13.

While a specific embodiment of the invention has been shown and described in detail to illustrate the application of the principles of the invention, it will be understood that the invention may be embodied otherwise without departing from such principles.

I claim:

1. A profiled tool shaping machine, comprising:

a machine frame;

a working head having a grinding disc rotatably mounted thereto about a disc axis and in a disc plane, said working head pivotably mounted to said frame about a vertical axis for horizontal pivoting of said disc and disc plane;

a work table slidably mounted to said frame for motion in at least two horizontal orthogonal directions with respect to said frame and said disc;

a work piece holder mounted to said table for holding a work piece adjacent said disc, which work piece is to be shaped into a profiled tool;

a dummy template having a profile corresponding to a profile of a tool to be shaped, fixed to said table;

a feeler fixable to said frame and engaging said template for causing motion of said table in one direction when said template with said table is moved past said feeler in another direction;

a first lever connected to said working head for pivoting said working head with said disc about said vertical axis;

a compensator member connected to said frame and having a plurality of positions defined thereon;

a first linkage connected between said first lever and said compensator member at one of said plurality of positions; and a second linkage connected between said table and said compensator member at one of said plurality of positions so that, movement of said first lever causes simultaneous movement of said table in said other direction and rotation of said working head with said disc about said vertical axis by selected amount proportional to the movement of said table in said other direction.

2. A machine according to claim 1 wherein said compensator member is pivotably mounted to said frame about a substantially horizontal axis, at least some of said plurality of positions being below said horizontal axis and a remainder of said plurality of positions being above said horizontal axis, a first slide slidably mounted to said compensator member and movable to any of said plurality of positions, said first slide connected to said first linkage, a second slide slidably mounted to said compensator member and movable to any of said plurality of positions, said second slide connected to said second linkage, said first linkage pivotably mounted to said first lever at an end of said first linkage opposite from said slide and said second linkage pivotably mounted to said table at an end of said second linkage opposite from said second slide.

3. A machine according to claim 2 wherein said compensator member is arcuate and curved concavely in a direction facing said first lever and table, movement of said first lever causing rotation of said working head about said vertical axis with no movement of said table in said other direction when said second slide is at a position on said compensator member in line with said horizontal axis, said table moving by a selected amount in said other direction when said second slide is at a position away from said horizontal axis.

4. A machine according to claim 3 including a graduated scale on said curved compensator member for indicating a position of each of said first and second slides.

5. A machine according to claim 2 wherein, with said first slide in a position below said horizontal axis, said working head is rotated with respect to said table to produce one of a convex and a concave profile portion on a work piece, and with said first slide above said horizontal axis, said working head is rotated to produce the other of a convex and concave profiled portion on a work piece.

6. A machine according to claim 5 including a pantographic table connected to said frame and carrying said feeler for moving said feeler into a feeler position and engagement with at least a portion of said template, and fixing said feeler at said feeler position.

7. A machine according to claim 1 inluding a pantographic table connected to said frame and carrying said feeler for moving said feeler into a feeler position and engagement with at least a portion of said template, and fixing said feeler at said feeler position.

8. A machine according to claim 1 including a vertical shaft connected to said frame through which said vertical axis extends and on which said working head is mounted for pivotable motion, and a lifting pin connected to said shaft and movable into a lifted position in engagement with said grinding disc to align said grinding disc plane with said vertical axis.

9. A machine according to claim 1 wherein said first linkage is removably connected to said first lever to permit rotation of said working head about said vertical axis by 90° to bring said disc plane into an orientation which is spaced away from said work piece holder so that said working head can be used as a grinder.

10. A machine according to claim 1 including a second lever pivotably mounted to said frame and engaged with said table for moving said table in said one direction to move said template past said feeler.

* * * * *